US006158073A

United States Patent [19]

Jiovanni

[11] Patent Number: 6,158,073

[45] Date of Patent: Dec. 12, 2000

[54] ROUND BRUSH APPARATUS FOR BRUSHING A PERSON'S HAIR

[76] Inventor: Matthew Jiovanni, 3450 N. Elaine Pl., Apartment 2, Chicago, Ill. 60657

[21] Appl. No.: 09/241,154

[22] Filed: Feb. 1, 1999

[51] Int. Cl.[7] ..... A46B 13/02

[52] U.S. Cl. ..... 15/23

[58] Field of Search ..... 15/22.1, 23, 28

[56] References Cited

U.S. PATENT DOCUMENTS

| | | | |
|---|---|---|---|
| 1,766,140 | 6/1930 | Narducci | 15/23 |
| 1,926,223 | 9/1933 | Albera | 15/23 |
| 3,019,463 | 2/1962 | Mitchell | 15/23 |
| 3,427,674 | 2/1969 | Tone et al. . | |
| 3,431,571 | 3/1969 | Kraus . | |
| 3,813,720 | 6/1974 | Sylvie | 15/23 |
| 3,890,984 | 6/1975 | Lesetar | 15/23 |
| 3,894,547 | 7/1975 | Sciovoletto | 15/23 |
| 4,084,282 | 4/1978 | Calvert | 15/23 |
| 4,137,588 | 2/1979 | Sandt et al. | 15/23 |
| 4,964,398 | 10/1990 | Jones | 15/22.1 |
| 5,353,461 | 10/1994 | Enriquez | 15/23 |

FOREIGN PATENT DOCUMENTS

| | | | |
|---|---|---|---|
| 638480 | 4/1962 | Italy | 15/23 |

*Primary Examiner*—Terrence R. Till
*Attorney, Agent, or Firm*—David J. Archer

[57] ABSTRACT

A round brush apparatus is disclosed for brushing a person's hair. The apparatus includes an elongate brush body having a first and a second end. The brush body includes a first member, which extends from the first end of the body towards the second end of the body. A plurality of bristles extends radially outwardly from the first member. A second member extends from the first member to the second end of the brush body. A handle portion has a first and a second extremity with the first extremity of the handle portion being drivingly connected to the second member of the brush body. The handle portion includes a handle, which extends from the second extremity of the handle portion towards the first extremity of the handle portion. A motor is disposed within the handle the motor being electrically connected to a power source. A tubular extension extends from the handle to the first extremity of the handle portion. The tubular extension removably receives therein the second member of the brush body, the arrangement being such that when the motor is energized, the motor rotates the second member of the brush body and the first member secured thereto so that carpal tunnel syndrome and the like disorders associated with manual round brushing of the person's hair is inhibited.

22 Claims, 4 Drawing Sheets

ROUND BRUSH APPARATUS FOR BRUSHING A PERSON'S HAIR

BACKGROUND OF THE INVENTION

FIELD OF THE INVENTION

The present invention relates to a round brush apparatus for brushing a person's hair. More specifically, the present invention relates to a motorized round brush apparatus.

INFORMATION DISCLOSURE STATEMENT

In a beauty salon, a hair stylist will round brush a client's hair during a blow dry procedure or following the application of a perm in order to impart curl to the client's hair.

Typically, a round brush includes a handle and a cylindrical extension having bristles extending radially therefrom. By the application of a rotary motion of the wrist of the hair stylist, the round brush is rotated in order to impart a wave or curl to the client's hair. Consequently, a hair stylist will spend many hours each day using a manual round brush. However, by application of the rotary motion of the wrist, many hair stylists have induced wrist problems including carpal tunnel syndrome, which is a very painful inflammation in the region of the wrist.

Carpal tunnel syndrome (CTS) includes pain, or sometimes numbness, that affects the thumb and first three fingers, and may shoot from there up the wrist and arm. Gradually the pinching strength of these fingers may also be reduced.

The carpal tunnel is formed by the bones of the wrist and a dense ligament which passes over them. The tendons, which flex the fingers, pass through this tunnel from the muscles located in the region of the forearm to the bones that form the fingers. The median nerve, which brings electrical impulses to the muscles at the base of the thumb and also carries the sensations from the thumb and first three fingers, likewise passes through this same structure. When overuse causes the tendons to become inflamed and swollen, they press on the nerve, causing some of the symptoms of CTS.

CTS is common in people who do a great deal of typing, as well as carpenters, musicians, assembly line workers, as well as any others who must make repetitive motions of the fingers.

More specifically, all over the world, today's hairstyles are created with manual round brushes known as manual round brushes. Round brushes have been widely used since the 1970's and are of a fairly standard construction. To acheve a great blow style takes a lot of work and is difficult, time consuming, strenuous and tiring. Also, the technique is actually a very bad movement for the wrist, hands and fingers to the point where professional hairstylists in increasing numbers are being forced to leave their professions due to the aforementioned CTS and other wrist and joint problems caused by excessive and improper use of the wrists, hands and fingers. Also, it is very difficult for someone at home to create a professional salon quality blow-dry.

The present invention overcomes the aforementioned problems associated with use of a manual round brush by the provision of an apparatus which includes a motorized mechanism for imparting a rolling operation to a client's hair, thus overcoming the problem of carpal tunnel disorders and other repetitive motion injuries.

Therefore it is a primary objective of the present invention to provide a round brush apparatus which overcomes the problems associated with the prior art manual round brush devices and which makes a considerable contribution to the art of hair styling.

Another feature of the present invention is the provision of a motorized round brush apparatus for brushing a person's hair so that the brush can be rotated in either direction for imparting waves to a client's hair.

Additionally, the round brush according to the present invention includes a handle which houses an extremely powerful but lightweight electric motor that at a press of a button, causes the head of the brush to spin.

Also included is a momentary switch to give a precise control over the spin of the brush head, that is the brush body. Such switch permits the brush head to turn when the user wants it turned on so that the problem of having the brush becoming tangled in a client's hair is overcome.

Furthermore, a dual direction or double throw switch permits at a flip of the switch, a change in direction in which the brush head spins. This allows anyone, whether left or right handed, to use the brush and to create any style.

The brush heads are fully detachable and the stylist can snap on any size round brush to create any style. For example, large natural bristles for smoothness, smaller heads for body and a thermal core for volume and wave.

Also, the apparatus includes an expandable cord which can be long enough to permit the stylist freedom to move while styling a client's hair. The cord could include a coiled telephone receiver type conductor in order to avoid tangling of an excessively long cord.

The handle is padded with foam to provide a comfortable and positive grip and also avoids the potential problem of dropping the brush when handling slippery hair products. The handle being padded increases its comfort particularly if the user suffers from CTS.

Other features and advantages of the present invention will be readily apparent to those skilled in the art by a consideration of the detailed description contained hereinafter taken in conjunction with the annexed drawings.

SUMMARY OF THE INVENTION

The present invention relates to a round brush apparatus for brushing a person's hair. The apparatus includes an elongate brush body having a first and a second end. The brush body includes a first member, which extends from the first end of the body towards the second end of the body. A plurality of bristles extend radially outwards from the first member. Also, a second member extends from the first member to the second end of the brush body.

A handle portion has a first and a second extremity, the first extremity of the handle portion being drivingly connected to the second member of the brush body. The handle portion includes a handle which extends from the second extremity of the handle portion towards the first extremity of the handle portion. A motor is disposed within the handle, the motor being electrically connected to a power source. A tubular extension extends from the handle to the first extremity of the handle portion. The tubular extension removably receives therein the second member of the brush body. The arrangement is such that when the motor is energized, the motor rotates the second member of the brush body and the first member secured thereto so that carpal tunnel syndrome and the like disorders associated with manual round brushing of the persons hair is inhibited.

Many variations and modifications of the present invention will be readily understood by those skilled in the art. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWING

Figure 1:
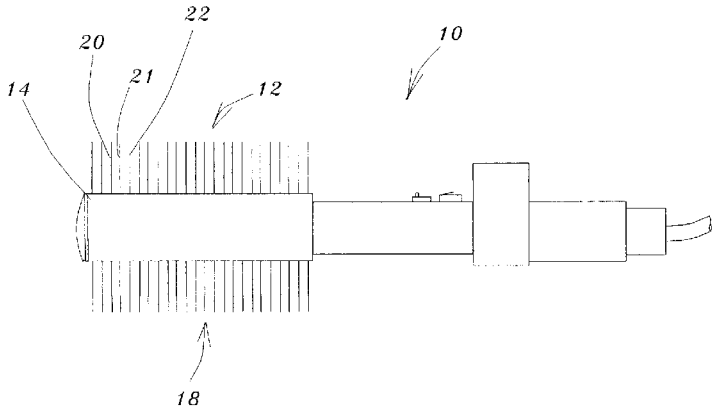
FIG. 1 is a side elevational view of a round brush apparatus according to the present invention.

FIG. 1 is a side elevational view of a round brush apparatus generally designated 10 for brushing a person's hair. The apparatus 10 includes an elongate brush body generally designated 12 having a first and a second end 14 and 16 respectively. The brush body 12 includes a first member generally designated 18 which extends from the first end 14 of the brush body 12 towards the second end 16 thereof A plurality of bristles 20, 21 and 22 extend radially outwardly from the first member 18.

Figure 2:
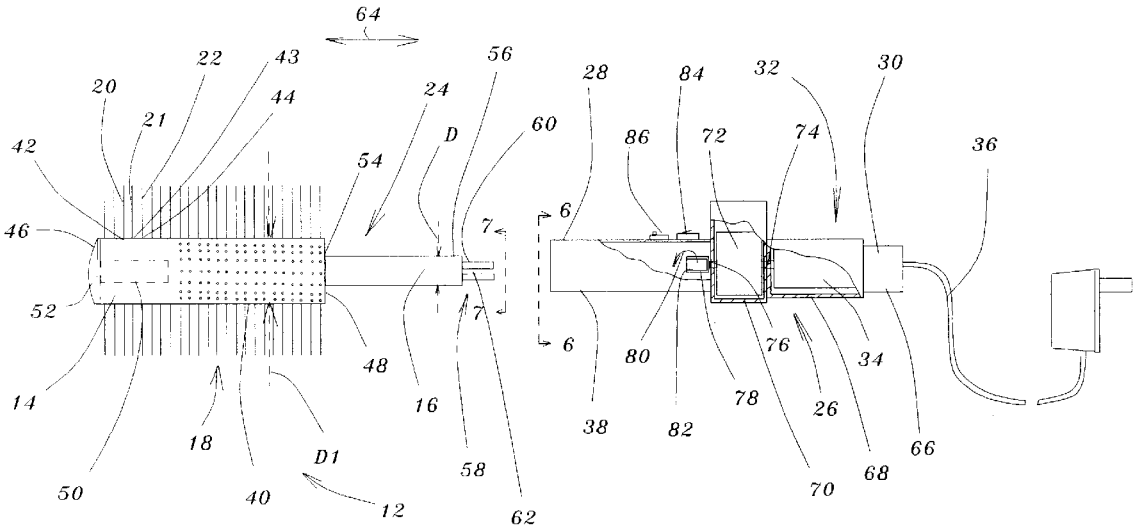
FIG. 2 is a similar view to that shown in FIG. 1 but with the brush body detached from the handle portion of the brush apparatus.

FIG. 2 is a similar view to that shown in FIG. 1 but shows the brush body 12 detached from the handle portion of the brush apparatus 10. As shown in FIG. 2, a second member generally designated 24 extends from the first member 18 to the second end 16 of the brush body 12.

A handle portion generally designated 26 has a first and a second extremity 28 and 30 respectively. The first extremity 28 of the handle portion 26 is drivingly connected to the second member 24 of the brush body 12. The handle portion 26 includes a handle generally designated 32 which extends from the second extremity 30 of the handle portion 26 towards the first extremity 28 of the handle portion 26. A motor 34 is disposed within the handle 32, the motor 34 being electrically connected by a power cord 36 to a power source (not shown).

A tubular extension 38 extends from the handle 32 to the first extremity 28 of the handle portion 26. The tubular extension 38 removably receives therein the second member 24 of the brush body 12. The arrangement is such that when the motor 34 is energized, the motor 34 rotates the second member 24 of the brush body 12 and the first member 18 secured thereto so that carpal tunnel syndrome and the like disorders associated with the prior art manual round brushing of the person's hair is inhibited.

Figure 3:
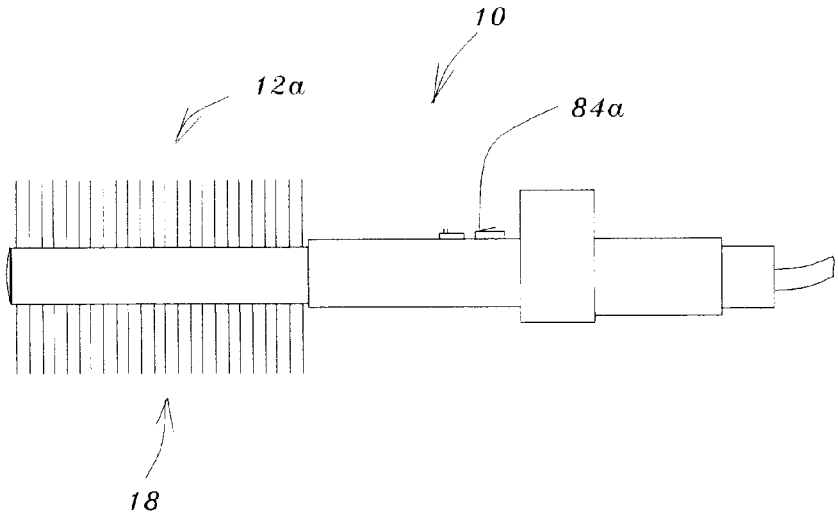
FIG. 3 is a similar view to that shown in FIG. 1 but shows a different size brush body attached to the handle portion of the brush apparatus.

FIG. 3 is a similar view to that shown in FIG. 1 but shows a different size brush body attached to the handle portion of the brush apparatus. As shown in FIG. 3, the apparatus 10 includes a further brush body 12A of a different size relative to the brush body 12. The further brush body 12A is interchangeable with the brush body 12 for accomplishing a different hair styling operation. Those skilled in the art will appreaciate that a whole range of various brush body sizes and types would be interchangeable with the brush body 12 in order to accomplish a particular styling technique.

Figure 4:
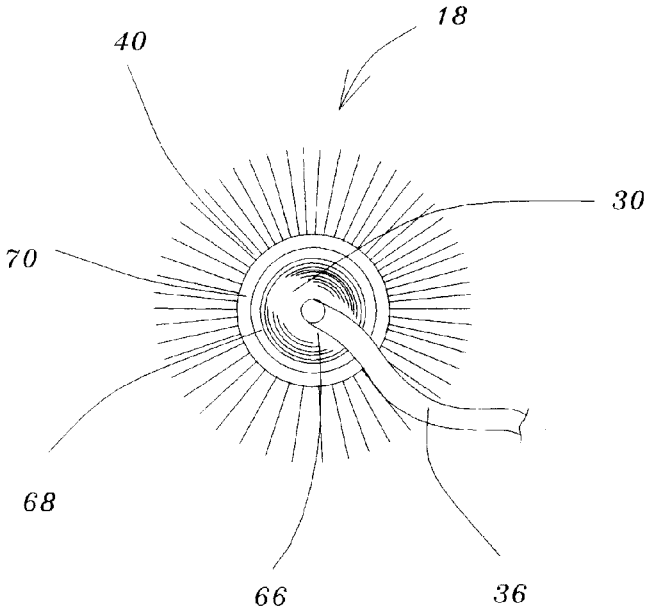
FIG. 4 is an end view of the brush apparatus shown in FIG. 1 viewed from the right hand side of FIG. 1.

FIG. 4 is an end view of the brush apparatus shown in FIG. 1 viewed from the right hand side of FIG. 1. As shown in FIG. 4, the first member 18 is of cylindrical configuration and has a cylindrical surface 40.

More specifically, the cylindrical surface 40 defines a plurality of holes 42, 43 and 44 for receiving and anchoring therein the bristles 20, 22 and 23.

The first member 18 has a first and a second face 46 and 48 respectively. The first face 46 defines a bore 50 which is disposed coaxially relative to the cylindrical surface 40.

Figure 5:
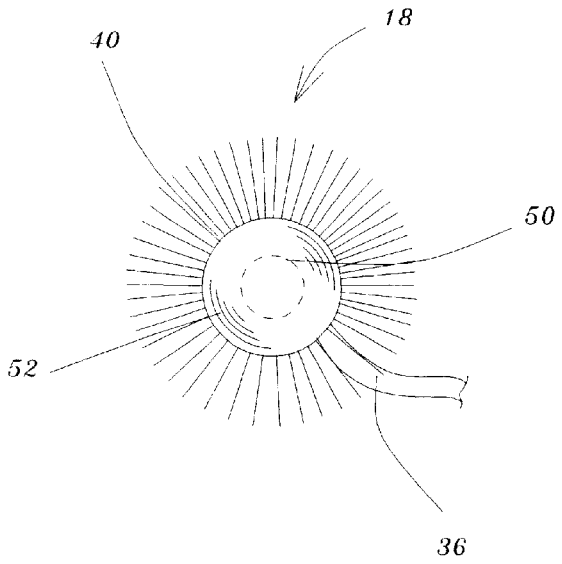
FIG. 5 is an end view of the round brush apparatus shown in FIG. 1 but viewed from the left hand side thereof.

FIG. 5 is an end view of the round brush apparatus shown in FIG. 1 but viewed from the left hand side thereof. As shown in FIG. 5, the first member 18 further includes an end cap 52 which cooperates with and is secured within the bore 50.

The first member 18 is preferably fabricated from an aluminum alloy such that during a styling operation, heat applied from a blow dryer towards the first member 18 heats the first member 18. The first member 18 retains the heat and thus enhances the styling operation and produces a smoother texture to the client's hair.

Figure 6:
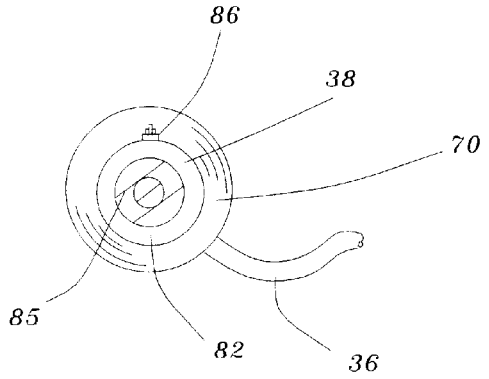
FIG. 6 is an end view of the handle portion as viewed on the line 6—6 of FIG. 2.
Figure 7:
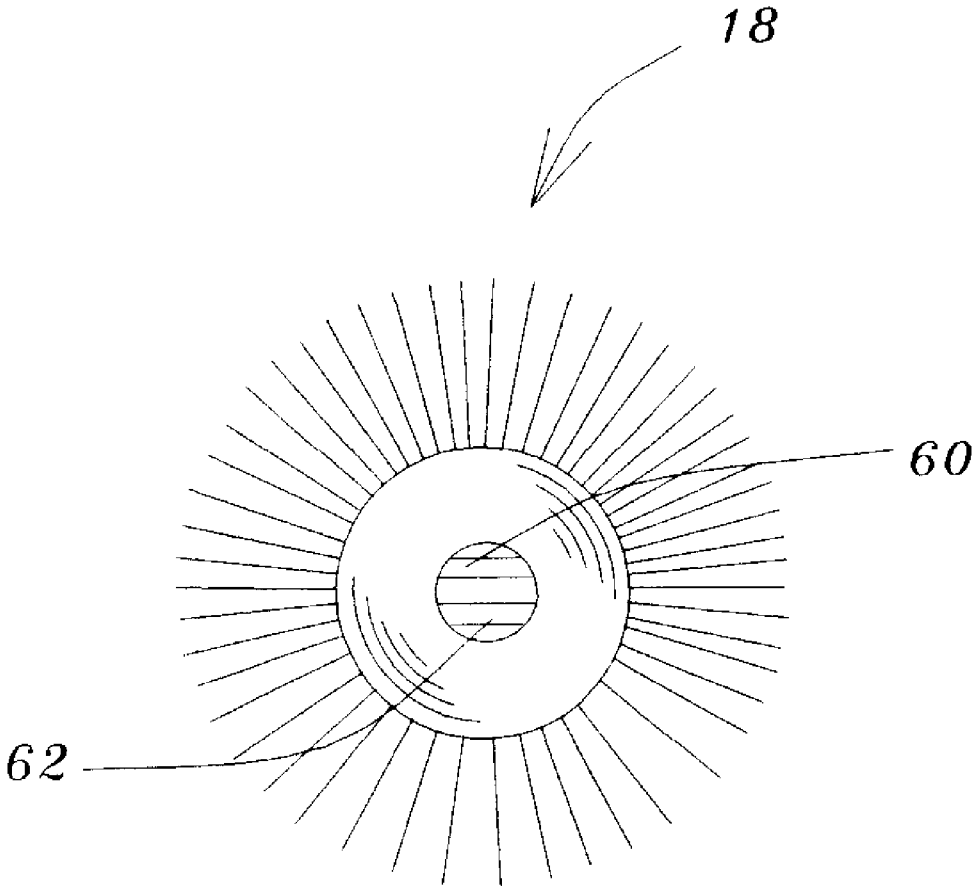
FIG. 7 is a sectional view of the second member as viewed on the line 7—7 of FIG. 2.

FIG. 6 is an end view of the handle portion as viewed on the line 6—6 of FIG. 2 and FIG. 7 is a sectional view of the second member as viewed on the line 7—7 of FIG. 2. As shown in FIGS. 6 and 7, the second member 24 of the brush body 12 is of elongated cylindrical configuration having a proximal and a distal end 54 and 56 respectively. Also, the second member 24 has a diameter D which is less than a diameter D1 of the first member 18.

The proximal end 54 of the second member 24 extends from the second face 48 of the first member 18. The first and the second members 18 and 24 respectively are disposed coaxially relative to each other.

The distal end 56 of the second member 24 includes a coupling generally designated 58 for coupling the second member 24 to the motor 34.

More specifically, the coupling 58 includes a first extension 60 which extends as a chord across the diameter D of the second member 24. A second extension 62 also extends as a chord across the diameter D of the second member 24, the second extension 62 being disposed parallel to and slightly spaced from the first extension 60 so that the extensions 60 and 62 respectively are resiliently disposed relative to each other such that insertion and removal of the brush body 12 within the tubular extension 38, as indicated by the arrow 64, for coupling the brush body 12 to the motor 34 is permitted.

The handle 32 includes an electrical inlet housing 66 which is disposed adjacent to the second extremity 30 of the handle portion 26. A motor housing 68 is secured to the inlet housing 66 for housing the motor 34. Also, a gearbox housing 70 is disposed between the motor housing 68 and the tubular extension 38.

The handle 32 further includes a gearbox 72 which is disposed within the gearbox housing 70. The gearbox 72 is operably connected to the motor 34 such that when the motor 34 is activated, the motor 34 drives the gearbox 72 for rotating the brush body 12.

In a preferred embodiment of the present invention, the gearbox housing 70 is eccentrically offset relative to the motor housing 68 so that the gearbox housing 70 and the motor housing 68 cooperate together for the comfortable reception thereof within an operator's hand during use of the apparatus 10 thus permitting the operator to easily adjust the disposition of the brush body 12 relative to the person's hair without subjecting the operator's hand and wrist to movements that would lead towards disorders such as carpal tunnel syndrome.

In a more specific embodiment of the present invention, the gearbox 72 includes an input 74 which is connected to the motor 34 and an output 76 which is connected to the second member 24 of the brush body 12. A coupler 78 is secured to the output 76 so that rotation as indicated by the arrow 80 of the output 76 rotates the coupler 78. The coupler 78 is disposed within the tubular extension 38 adjacent to the handle 32 for drivingly cooperating with the second member 24 of the brush body 12.

More particularly, the coupler 78 drives the brush body 12 and the distal end 56 of the second member 24 includes the coupling 58 for coupling the second member 24 to the coupler 78. The coupler 78 defines a diametrical slot 82 for the removable reception therein of the coupling 58 so that the extensions 60 and 62 respectively are removably and resiliently disposed within the slot 82 of the coupler 78.

Also, the apparatus 10 includes a single throw on/off switch 84 which is secured to the tubular extension and electrically connected to the motor 34 for controlling an electrical connection of the motor 34 with the power source.

Additionally, a double throw switch 86 is disposed between the single throw on/off switch 84 and the brush body 12. The double throw switch 86 is secured to the tubular extension 38 and is electrically connected to the single throw on/off switch 84 for reversing a rotational direction of the motor 34 is indicated by the arrow 80. More specifically, the switch 86 permits reversal of the direction of rotation of the brush body 12 relative to the handle portion 26 so that the apparatus can be readily used by both a right and a left handed hair stylist.

Also, in a further variation of the present invention, the motor 34*a,* as shown in FIG. 3, is a variable speed motor and a control 84*a* is secured to the handle portion and electrically connected to the motor for controlling the speed of the motor.

In operation of the round brush apparatus 10, the hair stylist selects a suitable brush body 12 for performing a particular hair styling operation. The selected brush body 12 is connected to the handle portion 26 by inserting the second member 24 within the tubular extension 38 until the coupling 58 engages the coupler 78 on the output 76 of the motor 34.

Subsequently, the stylist selects the correct setting for the double throw switch 86 so that the brush body 12 will rotate in the correct direction for performing the hair styling operation. Then the operator operates the single throw on/off switch 84 in order to energize the motor 34 and cause rotation of the brush body 12.

The round brush apparatus according to the present invention provides an apparatus which greatly improves the ability of a hair stylist to perform a round brush operation on a client's hair while avoiding the tendency for a hair stylist to induce problems associated with carpal tunnel syndrome and the like.

What is claimed is:

1. A round brush apparatus for brushing a person's hair, said apparatus comprising:

an elongate brush body having a first and a second end;

said brush body including:

a first member extending from said first end of said body towards said second end of said body;

a plurality of bristles extending radially outwardly from said first member;

a second member extending from said first member to said second end of said brush body;

a handle portion having a first and a second extremity, said first extremity of said handle portion being drivingly connected to said second member of said brush body;

said handle portion including:

a handle extending from said second extremity of said handle portion towards said first extremity of said handle portion;

a motor disposed within said handle, said motor being electrically connected to a power source; and a tubular extension extending from said handle to said first extremity of said handle portion, said tubular extension removably receiving therein said second member of said brush body, the arrangement being such that when said motor is energized, said motor rotates said second member of said brush body and said first member secured thereto so that carpel tunnel syndrome and the like disorders associated with manual round brushing of the person's hair is inhibited.

2. A round brush apparatus for brushing a person's hair as set forth in claim 1 further including:

a further brush body of a different size relative to said brush body, said further brush body being interchangeable with said brush body for accomplishing different styling operations.

3. A round brush apparatus for brushing a person's hair as set forth in claim 1 wherein said first member is of a cylindrical configuration, said first member having a cylindrical surface.

4. A round brush apparatus for brushing a person's hair as set forth in claim 3 wherein said cylindrical surface defines a plurality of holes for receiving and anchoring therein said bristles.

5. A round brush apparatus for brushing a person's hair as set forth in claim 3 wherein said first member has a first and a second face, said first face defining a bore disposed coaxially relative to said cylindrical surface;

said first member further including:

an end cap which cooperates with and is secured to said bore.

6. A round brush apparatus for brushing a person's hair as set forth in claim 3 wherein said first member is fabricated from an aluminum alloy such that during a styling operation, heat applied from a blow dryer towards said first member heats said first member, said first member retaining the heat thus enhancing the styling operation.

7. A round brush apparatus for brushing a person's hair as set forth in claim 3 wherein said second member of said brush body is of an elongated cylindrical configuration, said second member having a proximal and a distal end, said second member having a diameter which is less than a diameter of said first member.

8. A round brush apparatus for brushing a person's hair as set forth in claim 7 wherein said proximal end of said second member extends from said second face of said first member, said first and second members being coaxial relative to each other.

9. A round brush apparatus for brushing a person's hair as set forth in claim 7 wherein said distal end of said second member includes:

a coupling for coupling said second member to said motor.

10. A round brush apparatus for brushing a person's hair as set forth in claim 9 wherein said coupling includes:

a first extension which extends as a chord across said diameter of said second member;

a second extension which extends as a chord across said diameter of said second member, said second extension being disposed parallel and slightly spaced from said first extension so that said extensions are resiliently disposed relative to each other such that insertion and removal of said brush body within said tubular extension for coupling said brush body to said motor is facilitated.

11. A round brush apparatus for brushing a person's hair as set forth in claim 1 wherein said handle includes:

an electrical inlet housing disposed adjacent to said second extremity of said handle portion;

a motor housing secured to said inlet housing for housing said motor;

a gearbox housing disposed between said motor housing and said tubular extension.

12. A round brush apparatus for brushing a person's hair as set forth in claim 11 wherein said handle further includes:

a gearbox disposed within said gearbox housing, said gearbox being operably connected to said motor such that when said motor is activated, said motor drives said gearbox for rotating said brush body.

13. A round brush apparatus for brushing a person's hair as set forth in claim 12 wherein said gearbox housing is eccentrically offset relative to said motor housing so that said gearbox housing and said motor housing cooperate together for a comfortable reception thereof within an operator's hand during use of the apparatus thus permitting the operator to easily adjust the disposition of said brush body relative to the person's hair without subjecting the operator's hand and wrist to movements that would lead towards said disorders such as carpel tunnel syndrome.

14. A round brush apparatus for brushing a person's hair as set forth in claim 12 wherein said gearbox includes:

an input which is connected to said motor;

an output which is connected to said second member of said brush body;

a coupler secured to said output so that rotation of said output rotates said coupler, said coupler being disposed within said tubular extension adjacent to said handle for drivingly cooperating with said second member of said brush body.

15. A round brush apparatus for brushing a person's hair as set forth in claim 12 wherein said gearbox includes:

an input which is connected to said motor;

an output which is connected to said second member of said brush body;

a coupler secured to said output so that rotation of said output rotates said coupler, said coupler being disposed within said tubular extension adjacent to said handle for drivingly cooperating with said second member of said brush body;

said distal end of said second member including:

a coupling for coupling said second member to said coupler.

16. A round brush apparatus for brushing a person's hair as set forth in claim 15 wherein said coupler defines a diametrical slot for the removable reception therein of said coupling.

17. A round brush apparatus for brushing a person's hair as set forth in claim 1 further including:

a single throw on/off switch secured to said tubular extension and electrically connected to said motor for controlling an electrical connection of said motor with the power source.

18. A round brush apparatus for brushing a person's hair as set forth in claim 17 further including:

a double throw switch disposed between said single throw on/off switch and said brush body, said double throw switch being secured to said tubular extension and being electrically connected to said single throw on/off switch for reversing a rotational direction of said motor.

19. A round brush apparatus for brushing a person's hair as set forth in claim 1 wherein said motor is a variable speed motor.

20. A round brush apparatus for brushing a person's hair as set forth in claim 19 further including:

a control secured to said handle portion and electrically connected to said motor for controlling the speed of said motor.

21. A round brush apparatus for brushing a person's hair, said apparatus comprising:

an elongate brush body having a first and a second end;

said brush body including:

a first member extending from said first end of said body towards said second end of said body;

a plurality of bristles extending radially outwardly from said first member;

a second member extending from said first member to said second end of said brush body;

a handle portion having a first and a second extremity, said first extremity of said handle portion being drivingly connected to said second member of said brush body;

said handle portion including:

a handle extending from said second extremity of said handle portion towards said first extremity of said handle portion;

a motor disposed within said handle, said motor being electrically connected to a power source;

a tubular extension extending from said handle to said first extremity of said handle portion, said tubular extension removably receiving therein said second member of said brush body, the arrangement being such that when said motor is energized, said motor rotates said second member of said brush body and said first member secured thereto so that carpel tunnel syndrome and the like disorders associated with manual round brushing of the person's hair is inhibited;

said handle including:

a motor housing for housing said motor; and gearbox housing disposed between said motor housing and said tubular extension.

22. A round brush apparatus for brushing a person's hair, said apparatus comprising:

an elongate brush body having a first and a second end;

said brush body including:

a first member extending from said first end of said body towards said second end of said body;

a plurality of bristles extending radially outwardly from said first member;

a second member extending from said first member to said second end of said brush body;

a handle portion having a first and a second extremity, said first extremity of said handle portion being drivingly connected to said second member of said brush body;

said handle portion including:

a handle extending from said second extremity of said handle portion towards said first extremity of said handle portion;

a motor disposed within said handle, said motor being electrically connected to a power source;

a tubular extension extending from said handle to said first extremity of said handle portion, said tubular extension removably receiving therein said second member of said brush body, the arrangement being such that when said motor is energized, said motor rotates said second member of said brush body and said first member secured thereto so that carpel tunnel syndrome and the like disorders associated with manual round brushing of the person's hair is inhibited;

said handle including:

a motor housing for housing said motor;

a gearbox housing disposed between said motor housing and said tubular extension; and said gearbox housing being offset relative to said motor housing so that said gearbox housing and said motor housing cooperate together for a comfortable reception thereof within an operator's hand during use of the apparatus thus permitting the operator to easily adjust the disposition of said brush body relative to the person's hair without subjecting the operator's hand and wrist to movements that would lead towards said disorders such as carpel tunnel syndrome.

* * * * *